United States Patent [19]

Wright et al.

[11] 4,217,008

[45] Aug. 12, 1980

[54] DOCUMENT STORAGE SYSTEM

[75] Inventors: David M. Wright; Jerome O'Toole, both of Shrewsbury; Norman A. Hedstrom, Worcester, all of Mass.

[73] Assignee: Wright Line Inc., Watertown, Mass.

[21] Appl. No.: 671,614

[22] Filed: Mar. 29, 1976

[51] Int. Cl.[2] ..... A47B 63/00

[52] U.S. Cl. ..... 312/184; 312/216; 312/233

[58] Field of Search ..... 312/184, 233, 231, 216; 401/4, 38

[56] References Cited

U.S. PATENT DOCUMENTS

| | | | |
|---|---|---|---|
| 1,045,557 | 11/1912 | Ilges | 312/184 |
| 1,066,543 | 7/1913 | Stillwell | 312/184 |
| 2,112,094 | 3/1938 | Haskin | 312/233 |
| 2,494,382 | 1/1950 | Faulkner et al. | 312/233 |
| 2,501,608 | 3/1950 | Lyons | 312/233 |
| 2,794,697 | 6/1957 | Bergman | 312/233 |
| 3,208,457 | 9/1965 | Zippel | 312/184 |
| 3,275,279 | 9/1966 | Caldwell et al. | 312/233 |
| 3,639,020 | 2/1972 | Nesbitt | 312/184 |
| 3,866,993 | 2/1975 | Dean et al. | 312/216 |
| 3,888,558 | 6/1975 | Himsl | 312/216 |
| 3,923,353 | 12/1975 | Elias et al. | 312/184 |

FOREIGN PATENT DOCUMENTS

| | | | |
|---|---|---|---|
| 304613 | 10/1930 | Canada | 312/233 |
| 613566 | of 1935 | Fed. Rep. of Germany | 312/184 |
| 914369 | of 1949 | Fed. Rep. of Germany | 312/184 |
| 1071663 | 6/1960 | Fed. Rep. of Germany | 312/184 |
| 1120426 | of 1961 | Fed. Rep. of Germany | 312/233 |
| 455859 | 6/1913 | France | 312/184 |
| 1274556 | 9/1961 | France | 312/233 |
| 283515 | 8/1928 | United Kingdom | 312/233 |
| 485085 | 5/1938 | United Kingdom | 312/233 |
| 494465 | 10/1938 | United Kingdom | 312/233 |
| 755493 | 8/1956 | United Kingdom | 312/233 |
| 874994 | 8/1961 | United Kingdom | 312/184 |
| 912043 | 12/1962 | United Kingdom | 312/184 |
| 953121 | 3/1964 | United Kingdom | 312/233 |
| 1216952 | 12/1970 | United Kingdom | 312/184 |

*Primary Examiner*—Victor N. Sakran

*Attorney, Agent, or Firm*—Milton E. Gilbert

[57] ABSTRACT

A storage cabinet is provided which comprises at least one pull-out frame with a book support for supporting books so that they can be opened and read without removing them from the frame. The book support is in the form of a hanger bar from which the books are hung for storage. The hanger bar is adapted to permit the books to be easily pivoted up into a reading or use position and also to permit the books to be removed easily if pivoted to a selected book-releasing position.

5 Claims, 7 Drawing Figures

DOCUMENT STORAGE SYSTEM

This invention relates to the storing of documents and in particular to apparatus for storing documents for referencing purposes.

It is common practice to collect documents and bind them in groups in book form for classification and reference purposes. Catalogs, reference manuals, directories, instruction manuals, reports and other reference books are commonly assembled in loose leaf book form for reasons of cost and ease of replacement of pages. Many valuable computer printouts also are bound together for safekeeping and handling purposes. Such reference books are commonly stored on shelves and are removed to counters or desks for use. This practice is objectionable in those cases where the volumes are heavy and the counters or desks are remote from the shelves. On the other hand, frequently used volumes are often kept on top of counters or desks for ready access. This practice also is objectionable because the volumes occupy valuable work space, are accessible for inspection by unauthorized persons, and/or are vulnerable to damage by fire. Hence for reasons of economy of space and safe storage, it is desirable to provide means for storing reference books and other collections of documents in loose leaf book form so that they (1) can be closed off and protected by a locked door, (2) may be readily accessible, and (3) may be read in place or may be removed for use elsewhere or for the purpose of adding or deleting pages.

A desirable approach is to store the books by hanging them. However, presently there is no method or means for storing books by hanging them from a support which satisfies the above-mentioned requirements of security and access, while also allowing the option of using the books in place or easily removing them to some other work area. Means have been used to attach reference books such as telephone directories and other manuals to a shelf or other support so that each book normally is closed and occupies a stored position but can be pivoted to a use position wherein it can be opened for reading. However, such storage means are designed to prevent the books from being pilfered and are not suitable where the books have to be removed frequently for use elsewhere or to change pages.

Accordingly an important object of this invention is to provide a system for storing reference manuals, catalogs and other bound volumes of documents whereby they may be used without need to support them on a desktop or like work surface and can be closed off for fire protection and also to prevent unauthorized access or removal.

Another important object is to provide a storage cabinet for reference books such as manuals, catalogs, and the like which comprise a pull-out frame or shelf, and means for securing the books to the self so that any one of the books can be opened and read without removing it from the shelf.

The foregoing objects are achieved by providing a cabinet with a roll-out frame or shelf unit, and a hanger bar carried by the frame for hanging a plurality of books each having a hook engageable with the hanger bar, the hooks and hanger bar being designed so that the books can be pivoted on the bar to a use or read position and also can be detached if pivoted to a selected position.

Other features and many of the attendant advantages of the invention are set forth in or rendered obvious by the following detailed description wherein.

Figure 1:
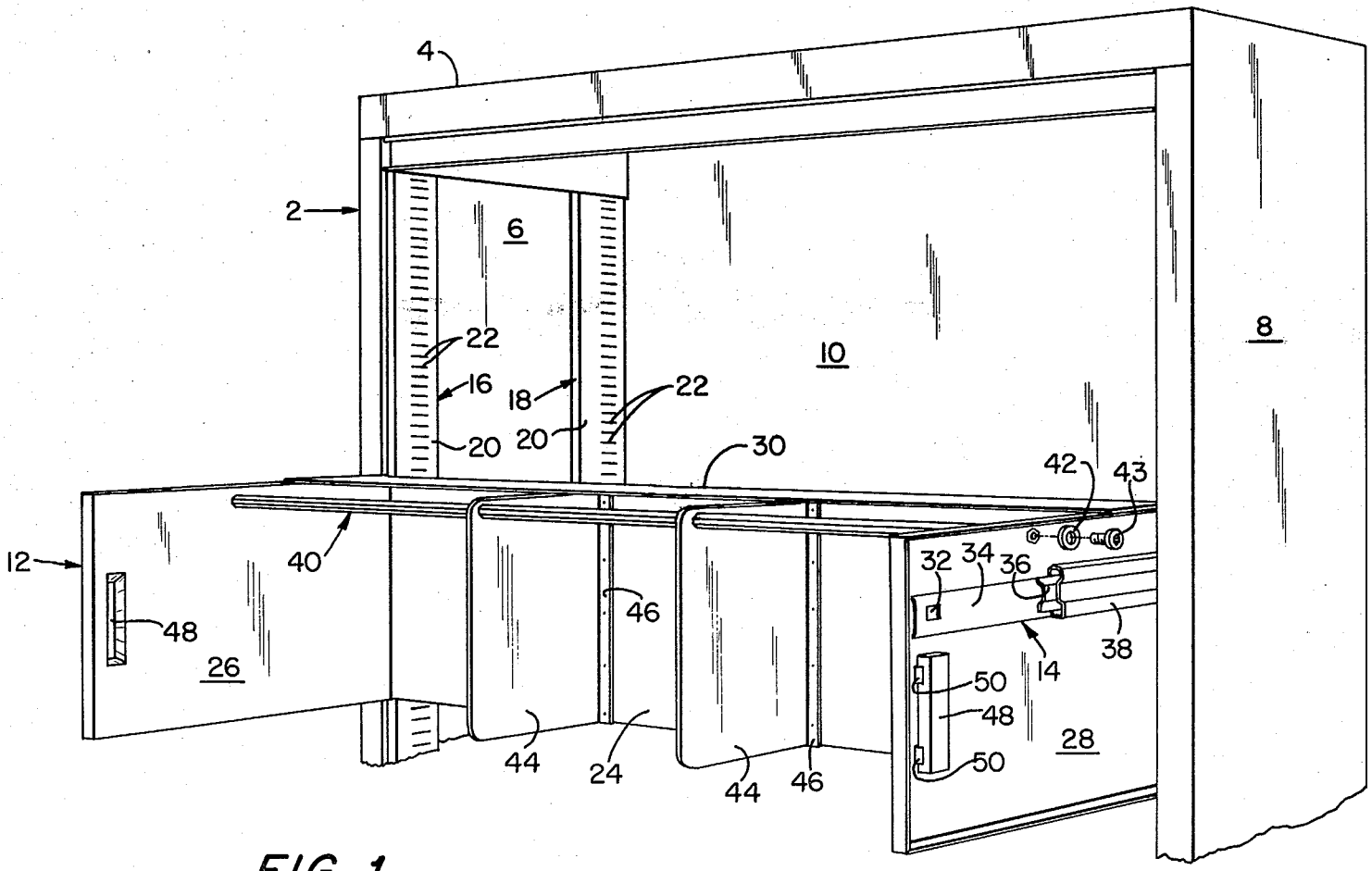
FIG. 1 is a fragmentary perspective view of a cabinet with a pull-out book storage unit constructed in accordance with this invention, the shelf unit being in extended or "use" position.
Figure 2:
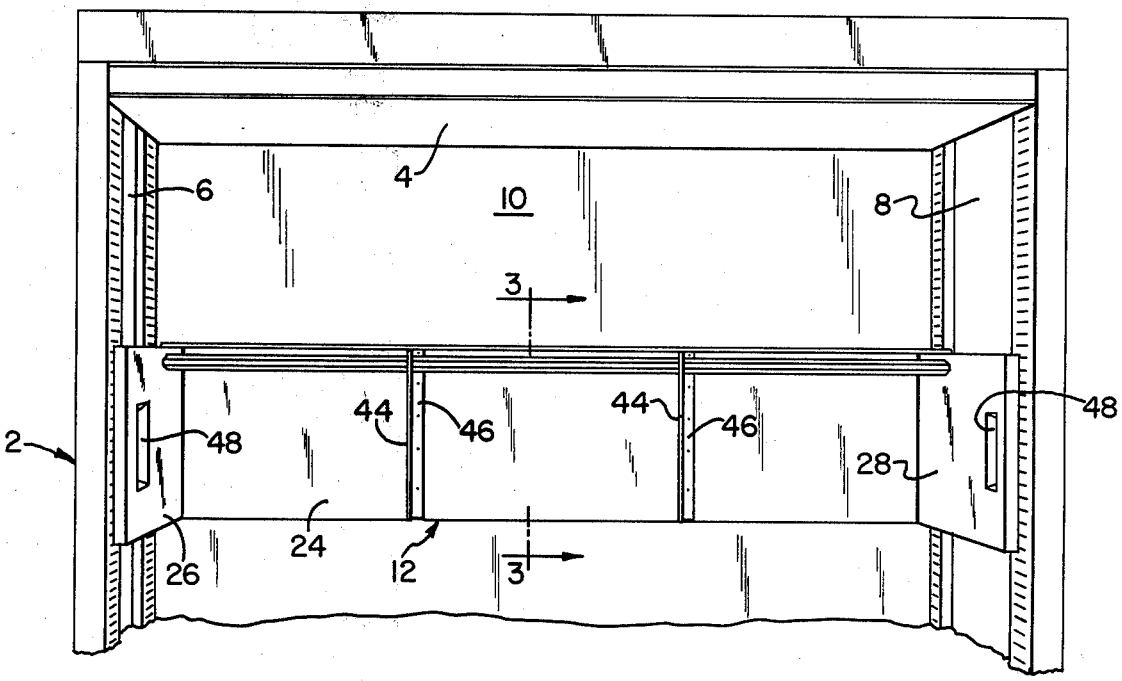
FIG. 2 is a fragmentary front elevation of the same cabinet with the pull-out unit in retracted or "store" position.
Figure 3:
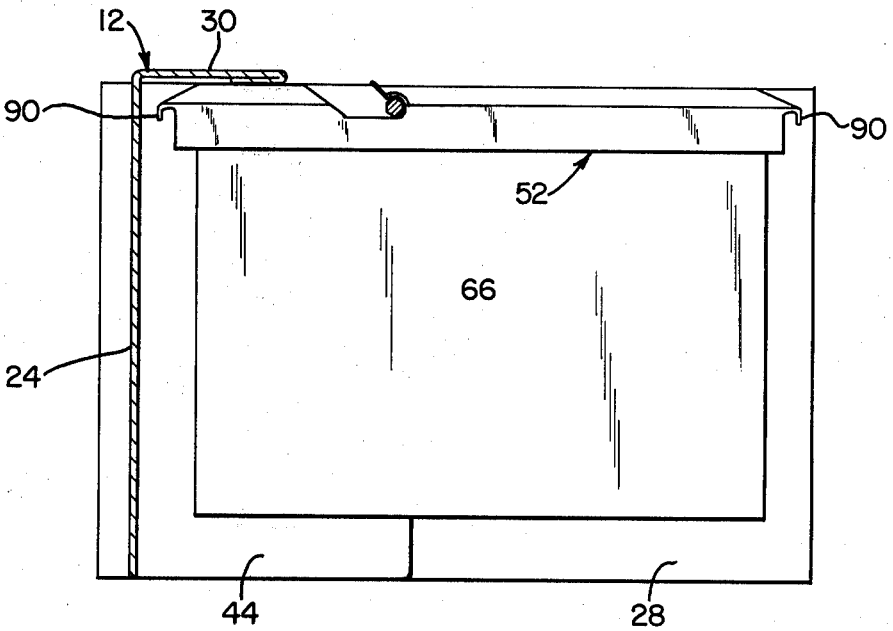
FIG. 3 is a sectional view taken along line 3—3 of FIG. 2.
Figure 4:
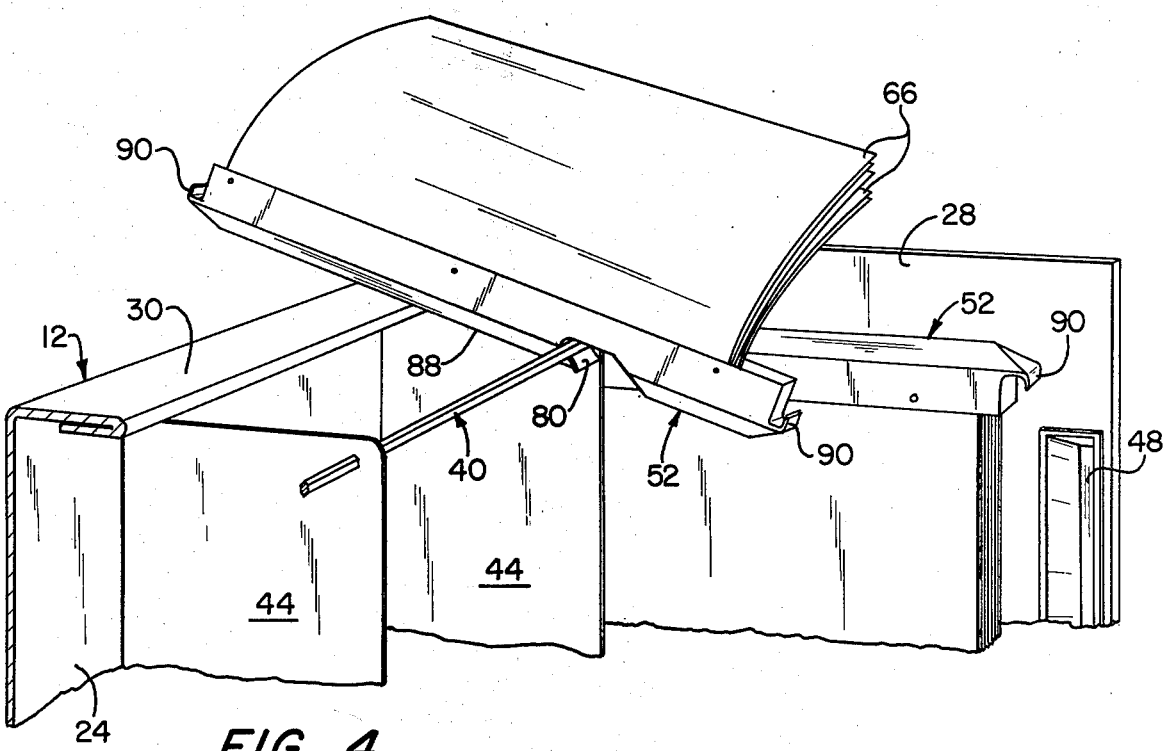
FIG. 4 is a fragmentary perspective view showing two similar loose-leaf reference books attached to the shelf unit, with one book being supported in position for reading.
Figure 5:
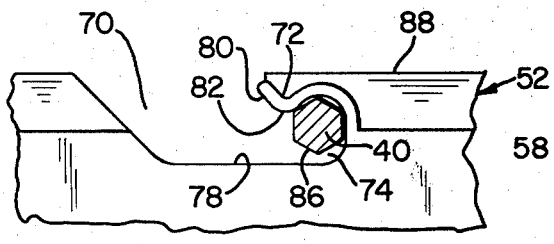
FIG. 5 is an elevational view of a portion of a book suspended from the hanger bar.

Turning to the drawings, FIGS. 1 and 2 illustrate an upper portion of a file cabinet 2 incorporating a preferred form of the present invention. The cabinet 2 may be of a conventional construction and consists of a top wall 4, opposite side walls 6 and 8, a rear wall 10 and a bottom wall (not shown) where are interconnected to form an integral structure. Cabinet 2 is adapted to include a tier of pull-out storage frames or shelves. For convenience of illustration, only one pull-out frame 12 is illustrated. However, it is to be appreciated that additional pull-out frames or shelves and also stationary shelves may be accommodated by the cabinet. Each pull-out storage frame is mounted on a pair of suspension arm units 14, only one of which is shown in the drawings. It is to be understood that the suspension arms are of conventional design. Preferably suspension arm units 14 are constructed and attached to the pull-out storage frame and the cabinet in substantially the same manner as the suspension arm units described and illustrated in U.S. Pat. No. 3,866,993. However, suspension arms of other known design may be used to mount the storage frames for pull-out action.

In accordance with the teachings of U.S. Pat. No. 3,866,993, two upright members 16 and 18 are attached to the inner sides of each of the side walls 6 and 8. These upright members 16 and 18 are essentially channel members and comprise body portions 20 which are spaced from the adjacent side wall and are provided with a series of vertically-spaced horizontally elongated slots 22. These slots serve to position the suspension units for the pull-out storage frames.

Referring now to FIGS. 1–4, pull-out frame 12 comprises a rear wall 24 secured to opposite side wall members 26 and 28 and a top frame member 30 which may be formed as a separate element and secured in place but preferably is an integral part of the member which makes up rear wall 24. Frame member 30 and rear wall 24 are disposed at a right angle to one another. Each of side wall members 26 and 28 is attached to a suspension arm unit 14. For this purpose, each side wall member is provided with a pair of mounting tabs 32, only one of which is shown. Each of the suspension arm units comprises three telescoping arms 34, 36 and 38 with arm 34 having a pair of slots to accommodate the tabs 32, whereby that arm is secured to the adjacent side wall member 26 or 28 so that frame 12 can move with that arm as the latter telescopes relative to arms 36 and 38. Each arm 38 also is provided with a pair of mounting tabs (not shown) for interlocking with the slots 22 in the adjacent uprights 16 or 18, thereby locking that arm against movement relative to the cabinet. Obviously the height of each pull-out frame 12 can be adjusted by raising or lowering the suspension arm units 14 with respect to the uprights 16 and 18 at each side of the cabinet. This permits a variable number of pull-out frames 12 to be mounted in the cabinet. Further details of the suspension arm unit 14 and how they are connected to the pull-out frame and cabient are omitted since they are not essential to an understanding of the invention and are obvious to a person skilled in the art.

Still referring to FIGS. 1–4, each frame 12 embodies a book support assembly which comprises a hanger bar in the form of a rod 40 which extends between and is secured to side wall members 26 and 28. Rod 40 may be secured to side wall member 26 and 28 in various ways. Preferably, however, rod 40 extends into openings in side wall members 26 and 28 and is secured there by washers 42 and screws 43 (see FIG. 1), the latter being secured in tapped holes in the ends of the rod. In the preferred mode of practicing this invention, rod 40 has a hexagonal shape in cross-section and, to prevent it from sagging when loaded, it is supported between its ends by one or more sheet metal panels 44 that are secured to rear wall 24. Preferably but not necessarily, each panel 44 has a flange 46 at its rear end which is secured to rear wall 24 by welding, screws or other suitable means. Rod 40 extends through a suitable hole in each panel 44. Panels 44 extend beneath frame member 30, so that the latter is elevated with respect to rod 40. Additionally rod 40 is disposed forwardly of the forward edge of frame member 30 but is located closer to the rear edges than the front edges of side wall member 26 and 28. Handles 48 are provided at the front ends of the side wall members to facilitate pulling the storage frame out of the cabinet to the extent permitted by suspension arm units 14. Handles 48 are preferably formed of a plastic material and may be secured to the side wall members in any suitable manner. By way of example, the side wall members are formed with elongate holes and the handles are adapted to be inserted in the holes and have projections 50 (FIG. 1) which make a snap-type interlocking fit with adjacent portions of the panels.

Referring now to FIGS. 4–7, several bound volumes are shown attached to hanger rod 40. These volumes consist of loose-leaf cartridge-type binders or holders 52 which are similar (in design but not necessarily in size) to the ones disclosed in Modern Office Procedukes, Vol. 20, No. 12, page 42, December 1975, and Information and Records Management, Vol. 9, No. 9, page 9, September 1975. Holders 52 are molded of a suitable plastic, e.g. polypropylene, and may be one-piece units or they may be made of two or more parts secured together. Each of the holders has a pair of oppositely inclined side walls 54 and 56, a pair of integral depending limbs 58 and 60 and one or more transversely-extending reinforcing struts 62. Limbs 58 and 60 define a channel 64 for receiving the margins of a plurality of documents or loose leaves 66. Each holder 52 also includes document binding means in the form of posts 68 which extend across channel 64 through suitable openings in the leaves 66 and are releasably connected to limbs 58 and 60. Binding posts 68 are preferably made of plastic and have a head 67 at one end and a flange 69 at the other end to interlock with limbs 58 and 60 respectively. Also each post is split at its second end so as to form two spring-like resilient sections 71 that can be caused to yield toward one another to permit flange 69 to be released from limb 58 whereby the post can be retracted to permit leaves to be added to or removed from the holder.

Additionally each holder 52 is formed with a notch 70 and a hook 72. Notch 70 is made large enough to loosely accommodate rod 40 and hook 72 is shaped so as to provide a reentry space 74 which is large enough to accept rod 40. For this purpose, the underside of hook 72 is a flat surface 76 which has a generally circular curvature in profile. The inner side of notch 70 is defined by a flat surface 78 which is essentially straight in profile. The end of hook 72 has a flat inclined end surface 80 which is a continuation of a reverse portion 82 of surface 76. Reverse portion 82 is spaced from the adjacent flat surface 78 of the holder by an amount which is less than the maximum cross-sectional dimension of the rod measured diametrically, but greater than the distance between two diametrically opposite surfaces 86 of the rod. Stated another way, the distance between the junction of any two adjacent surfaces 86 of the rod and the junction of two other surfaces where the junctions are diametrically opposed is greater than the gap between reverse portion 82 and surface 78.

Hook 72 is located closer to one end than the other of the holder, i.e., to one side of the center of gravity of the holder, and hanger rod 40 is disposed so that when a holder is hanging freely therefrom, the holder will tend to pivot so that its end nearest the hook will engage the underside of frame member 30 (FIG. 3) and be caused by the latter to hang level despite the fact that its pivot point is eccentric. Thus, the holder and its contents will be stabilized in a horizontal position.

Figure 6:
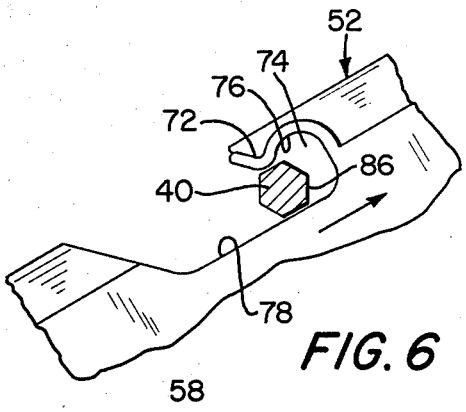
FIG. 6 is a view similar to FIG. 5 but with the book tilted to a release position.
Figure 7:
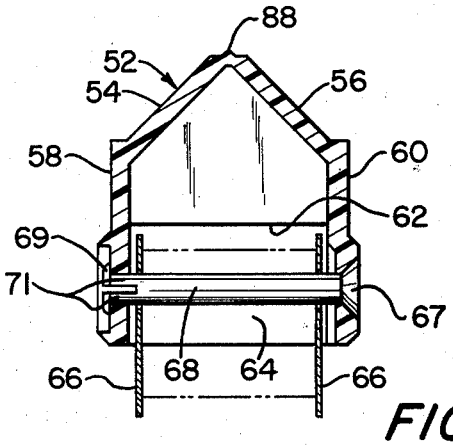
FIG. 7 is a cross-sectional view of the book of FIGS. 5 and 6.

The holder cannot be removed from the hanger bar simply by urging it away from back wall 24 since rod 40 is oriented as shown in FIGS. 3–6 so that its vertical cross-section dimension is greater than the gap between reverse portion 82 of hook surface 76 and flat surface 78. However, it also is an easy matter to remove a holder from the hanger bar. This is accomplished by pivoting the holder to where its surface 78 is parallel (in profile) to a pair of opposite surfaces 86 of the rod as shown in FIG. 6 and then urging the holder up away from the rod in the direction of the arrow. When this is done, hook 72 can be moved clear of rod 40 and the holder with its attached documents can then be transported to another location. Hanging a book on rod 40 is achieved in reverse to the manner in which it is removed. Once the holder has been placed in hanging relation with rod 40, the book will swing into the level position shown in FIG. 3. This same arrangement permits the holder to be pivoted so as to raise its forward end and lower its rear end away from frame member 30, and this pivoting action can be carried out enough to substantially reverse the position of the holder so that its limbs 58 and 60 and the pages or documents attached thereto face up and the spine 88 of the holder engages frame member 30, whereby the holder is supported in an inclined use position (FIG. 4) in which the pages can be spread apart and read just as conveniently as a book placed on a lectern. The holder can be pivoted to its use position without accidentally coming free of rod 40 since (1) the aligning of surface 78 parallel to any one of the surfaces 80 of the rod is only momentary as the holder is pivoted up and (2) gravity tends to keep the holder engaged with the rod. It will be appreciated that the pivot function also will work with a round rod that is smaller in diameter than the distance between reverse portion 82 and flat surface 78, since the eccentric location and the shape of the hook are such that in the hanging position and up-pivoted reference position, gravity will hold the books in place.

The structure just described allows books to be (a) stored, (b) opened in situ for use, and (c) removed for use elsewhere or to permit removal or insertion of pages.

The invention is not required to use a rod with a hexagonal cross-section. Thus, for example, rod 40 may be replaced with a rod having a D-shaped cross-section, i.e., a rod which is essentially circular in cross-section but has a flat surface formed thereon. The radius of such a rod would exceed the gap between reverse portion 82 and surface 78 of the holder but its maximum cross-sectional dimension measured at a right angle to its flat would be less than the same gap, with the result that the holder could be installed on or removed from the rod only if it were pivoted so that the flat on the rod was aligned with surface 78 of the holder. The rod would be oriented so that its flat was not at the 12 o'clock or 6 o'clock positions, thereby assuring that the holder or book could not be removed by simply pulling it straight away from rear wall 24. Obviously a rod with two opposed flats or four equally spaced flats also could be used in place of rod 40.

It is to be noted that the cabinet may be provided with a keyed lock by which the frames or shelves (any any other pull-out components) may be secured in retracted position. Such a key lock mechanism is described and illustrated in U.S. Pat. No. 3,404,929. Other forms of key lock mechanism also may be employed to perform the same function. It is also contemplated that the cabinet may include shelf interlock mechanisms which prevent more than one frame or shelf from being pulled out at any one time and a door such as self-storing tambour which can be closed and locked to conceal and secure the contents of the cabinet. Such features also are disclosed in U.S. Pat. No. 3,866,993.

It is to be understood also that pull-out book supporting frames or shelves made in accordance with the present invention have utility and advantages even though loose-leaf holder means different than those herein described are used to provide bound volumes which can be mounted, pivoted and detached as herein contemplated. In this connection it is to be noted that holders 52 may be formed with end hooks 90 so that they can also be mounted on a pair of side rails as in conventional hanging file drawers.

Persons skilled in the art will also appreciate that the apparatus herein disclosed and illustrated may be modified in different ways (such as by changing the shape and arrangement of parts or by substituting a hollow rod for solid rod 40) without departing from the spirit and scope of the invention.

It is to be understood that as used herein the term "book" is intended to denote a collection of information-bearing documents or pages attached to a holder or binder, and the book may or may not include front and/or back covers. By way of example but not limitation, all of the following are "books" for the purpose of this invention: catalogs, parts and other reference manuals, reports, computer printouts, and the like.

What is claimed is:

1. A filing cabinet containing at least one book storage unit movable into and out of said cabinet and stationary hanger means disposed on said storage unit for (a) detachably supporting a plurality of books in a storage position in which the pages thereof depend downwardly and (b) permitting any one of said books to be pivoted from said storage position to a supported reading position in which the pages thereof face up and may be opened and read in situ, said storage unit having opposite side members, and said hanger means being a rod secured to and extending between said side members, said rod having at least one flat surface extending for substantially its full length between said said members and being adapted to be used with hook means carried by each of said books so as to permit a selected one of said books to be pivoted about said rod from said storage position to said reading position and also to be removed from said rod without detaching said rod from said storage unit only when pivoted to a selected position.

2. Apparatus according to claim 1 and further including a plurality of books each having a spine section comprising an open hook for engaging said hanger rod, said hooks and said rod cooperating to enable said books to pivot about said rod, a support member extending parallel to and spaced from said rod, said support member being disposed to station each of said books at an angle in said reading position and to impose a level position on said books when said pages are facing downward.

3. Apparatus according to claim 1 wherein said storage unit includes a support member extending parallel to and fixedly spaced from said rod, said support member being disposed to station each of said books at an angle in said reading position.

4. Apparatus according to claim 1 wherein said rod has maximum and minimum cross-sectional dimensions, and said maximum dimension is in a vertical plane.

5. Apparatus according to claim 4 wherein said rod has a polygonal cross-section.

* * * * *

UNITED STATES PATENT AND TRADEMARK OFFICE

CERTIFICATE OF CORRECTION

PATENT NO. : 4,217,008

DATED : August 12, 1980

INVENTOR(S) : David M. Wright et als

It is certified that error appears in the above-identified patent and that said Letters Patent are hereby corrected as shown below:

| | |
|---|---|
| Column 2, line 28: | Delete word "where" and substitute therefor the word "which" |
| Column 3, line 52: | Delete word "Procedukes" and substitute therefor the word "Procedures" |
| Column 4, line 40: | Delete word "cross-section" and substitute therefor the word "cross-sectional" |
| Column 5, line 31: | Delete at end of line the word "any" |
| Column 6, line 26: | Delete the word "said" where it appears in the second instance and substitute therefor the word "side" |

Signed and Sealed this

*Seventeenth* Day of *March 1981*

[SEAL]

*Attest:*

RENE D. TEGTMEYER

*Attesting Officer* *Acting Commissioner of Patents and Trademarks*